US005818493A

United States Patent [19]

Mc Lain et al.

[11] Patent Number: 5,818,493

[45] Date of Patent: Oct. 6, 1998

[54] METHOD OF PRINTING AN ELECTRONICALLY STORED MULTICOLOR MEDICAL IMAGE

[75] Inventors: James Allen Mc Lain, Little Farry, N.J.; Dirk De Langhe, Lokeren, Belgium

[73] Assignee: Agfa-Gevaert, Mortsel, Belgium

[21] Appl. No.: 453,663

[22] Filed: May 30, 1995

[30] Foreign Application Priority Data

Jul. 21, 1994 [EP] European Pat. Off. ..... 94202130

[51] Int. Cl.[6] ..... B41J 2/325

[52] U.S. Cl. ..... 347/172; 347/176

[58] Field of Search ..... 346/33 ME; 347/171, 347/172, 174, 176; 400/120.01, 120.02, 120.04

[56] References Cited

U.S. PATENT DOCUMENTS

| | | | |
|---|---|---|---|
| 4,786,917 | 11/1988 | Hauschild et al. | 347/172 |
| 4,816,902 | 3/1989 | Yamanishi | 347/172 |
| 5,453,775 | 9/1995 | Eguchi et al. | 347/176 |

*Primary Examiner*—Huan H. Tran
*Attorney, Agent, or Firm*—Baker & Botts, L.L.P.

[57] ABSTRACT

An electronically stored multicolor medical image obtained during a Doppler ultrasound diagnosis is printed, by means of thermal sublimation, using a dye donor element and receiver elements receiving dye from the dye donor element. Herein one or more color selections of the multicolor medical image is or are separately printed by transfer of a monochrome dye from the dye donor element on separate receiver elements.

11 Claims, 9 Drawing Sheets

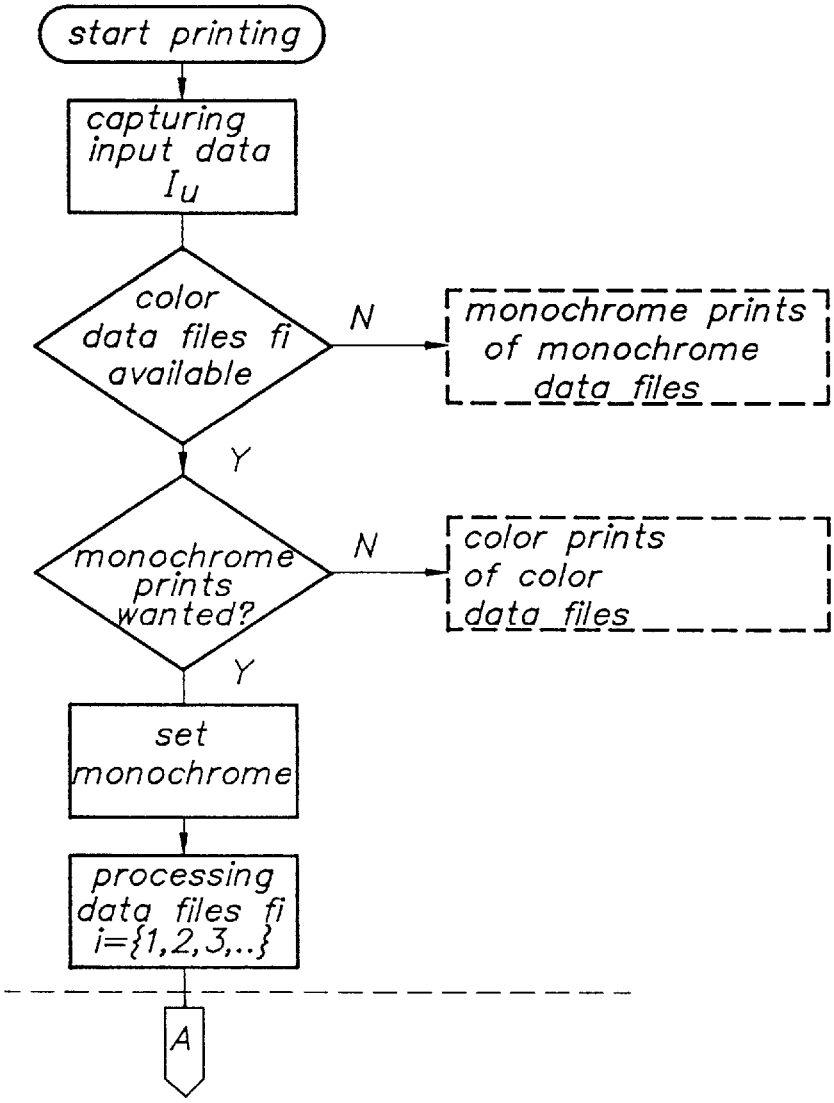
FIG. 10.1

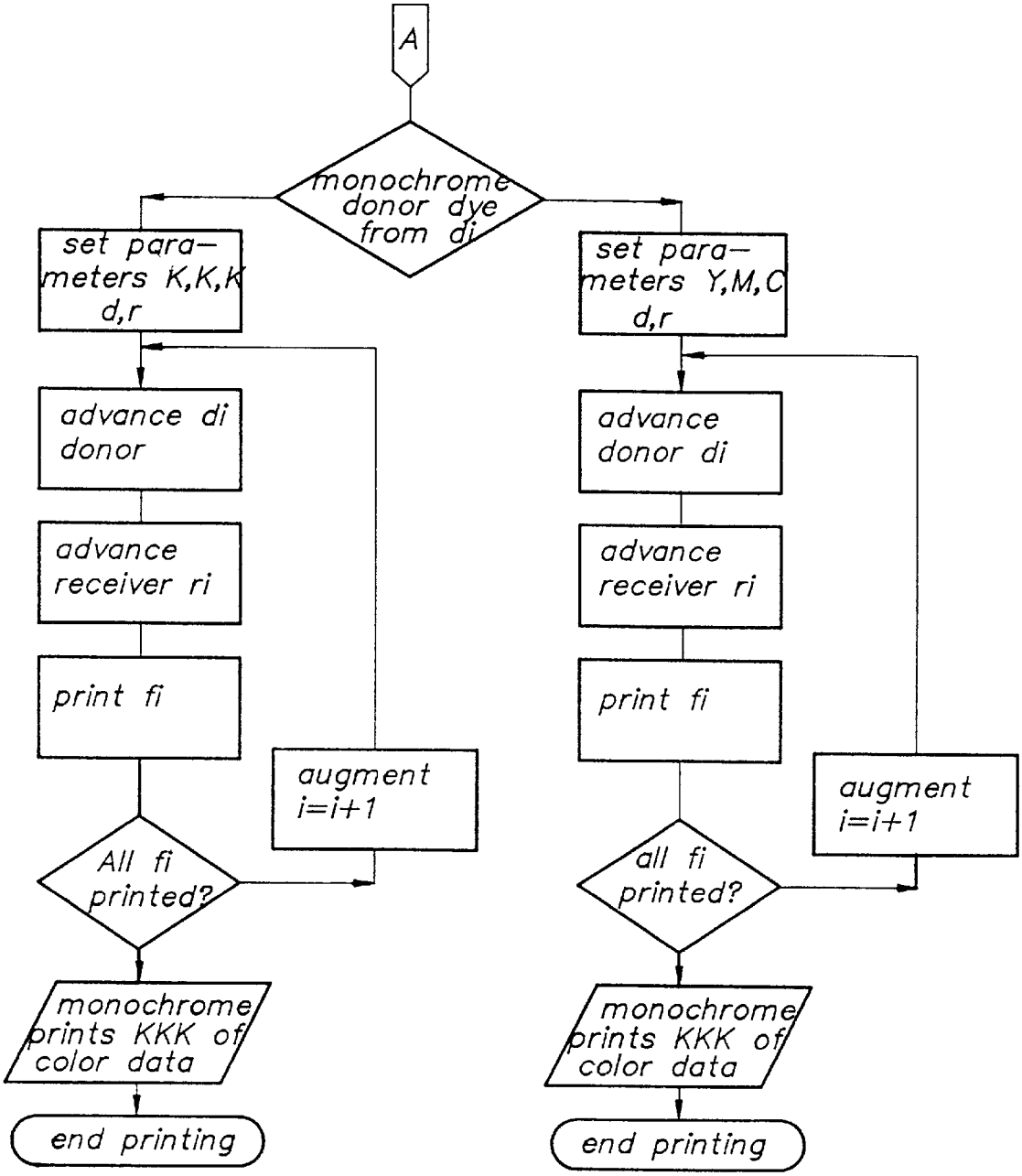
FIG. 10.2

METHOD OF PRINTING AN ELECTRONICALLY STORED MULTICOLOR MEDICAL IMAGE

FIELD OF THE INVENTION

The present invention relates to a thermal printing system for printing a reproduction of an electronically stored medical image by means of thermal sublimation, using a dye donor element containing heat transferable dyes. In particular, this invention relates to a method of representing an image of the interior of the human body obtained during medical diagnosis. Even more particularly, but not exclusively, this invention relates to a method for representing an image obtained during a Doppler ultrasound diagnosis.

BACKGROUND OF THE INVENTION

Medical applications of Doppler ultrasound include the identification of vessels, the determination of the direction of blood flow, the evaluation of narrowing or occlusion, and the characterization of flow to organs and tumors.

Images generated by medical ultrasound scanning devices use sound transducers to introduce high frequency sonic waves into the human body which are reflected back to the transducer according to the reflection characteristics of elements in the body. A visually projectable image of the reflective elements in a plane of the body can be generated by techniques known in the art and these elements can be recognized by trained radiologists. Often, a first diagnosis is performed on a color display of an image before recording on a hard-copy, which is used later on for the purpose of further, more detailed diagnosis and/or for archiving purposes.

In "Doppler ultrasound diagnosis", the direction and flow velocity in an artery or vein can be determined from the Doppler effect. An ultrasound beam of a given frequency is transmitted into the body at a known angle and is then reflected from a moving interface such as the red cells flowing in the blood of an artery or vein. The reflected sound wave will differ in frequency from the transmitted wave in accordance to whether the flow is toward the transducer or away from the transducer. If the flow is toward the transducer, the reflected frequency will be higher than the transmitted frequency. If the flow is away from the transducer, the reflected frequency will be lower than the transmitted frequency. A small proportional offset is the result of a slow velocity flow; a large proportional offset is the result of a fast velocity flow. These data thus determine the blood flow direction and velocity.

In so-called "flow or amplitude-based Doppler diagnosis", a separate color scale may be assigned to the direction of flow, where one color designates flow toward the transducer (e.g. red) and another designates flow away from the transducer (e.g. blue), so that quick visual means are estabished to show flow direction. Recently, sometimes a third (artificial) color (e.g. yellow) is added to designate turbulences, as they possibly occur at an inclusion.

In so-called "power Doppler diagnosis", in addition, hues of these colors (e.g. red moves toward yellow and blue moves toward green) are assigned to define the speed of flow, or velocity, through the artery or vein under test. Therefore a color flow imaging system utilizes a high resolution ultrasound imaging device performing simultaneously with real time imaging of flood flow and tissue.

In the further description, several references will be made to Doppler radiology or Doppler ultrasonography. For a better understanding of "Doppler ultrasonography", reference may be made e.g. to the book "Radiographics", volume 11, no. 1, january 1991, pages 109 to 119, published by the Radiological Society of North America Inc., part "AAPM Tutorial", chapter "Doppler US: The Basics", by R. B. Merritt; to "Parametric imaging using digital subtraction angiography", by Hunter et al., in The British journal of radiology, volume 59, n○ 697, january 1986, pp. 7 to 11; to "Farbkodierte Doppler-Sonographie . . . ", Schwaighofer et al., in RoFo Fortschritte auf dem Gebiete der Rontgenstrahlen und der Nuklearmedizin, Band 149, September 1993, Seite 310 bis 313; and to "Power Doppler expands standard color capability", by Rubin and Adler, in Diagnostic Imaging, december 1993, pp. 66 to 69.

The information of a flow Doppler diagnosis is generally presented as a color-coded image; the information of a power Doppler diagnosis is generally presented as a colored image. For sake of convenience, in the further description the general wording "multicolor image" is used, which includes as well a color-coded image, as well as a colored image. Yet, it is widely known that the interpretation of the graphic display of Doppler data may be difficult or confusing. Because the Doppler signal itself has no anatomic significance, the examiner must interprete the Doppler signal and then determine its relevance in the context of the image.

A hard-copy of such a color-coded or colored image can be printed by a thermal sublimation printer which uses a dye donor element comprising a series of dye frames of heat transferable dyes. A schematic layout of such a printer is given in FIG. 2. The apparatus 10 generally comprises a cylindrical printing drum 15 which functions to support and transport an image receiving sheet 11 through a print zone where it receives thermally printed information. A dye-bearing donor element 12 is advanced through the print zone between the image receiving sheet 11 and a thermal printing head 16. Thermal head 16 spans the printing drum 15 and comprises a linear array (not shown) of closely spaced resistive heating elements, each being independently addressable with image information supplied by a microprocessor. As each heating element is addressed, it heats that portion of the donor element 12 directly opposite, thereby causing dye to transfer from the donor element 12 to the image receiving element 11; The image receiving sheets 11 are fed to the drum 15 from a sheet loader 22 and are laid down in an output tray 23, which has been illustrated within the apparatus 10 but which may be located in front of the apparatus 10 as well.

However, in particular circumstances, the attained perceptibility of density variations on the hard-copy is not enough. Yet, it will be clear that, especially in radiological diagnosis, poor discrimination of said density variations might have very serious consequences.

OBJECT OF THE INVENTION

It therefore is an object of the present invention to provide an improved method of thermal sublimation printing for reproducing a medical image obtained during a Doppler ultrasound diagnosis and represented by a digital image signal so that increased diagnostic information is obtained.

Further objects and advantages of the present invention will become clear from the description hereinafter.

SUMMARY OF THE INVENTION

According to the present invention there is provided a method of printing an electronically stored multicolor medical image, by means of thermal sublimation, using a dye donor element and receiver elements receiving dye from said dye donor element, wherein one or more color selections of said multicolor medical image is or are separately printed by transfer of a monochrome dye from said dye donor element on separate receiver elements. More preferably, said monochrome dye is achromatic.

BRIEF DESCRIPTION OF THE DRAWINGS

The present invention will be described hereinafter by way of example with reference to the accompanying drawings, wherein:

FIGS. 6 to 10.2 are flow-charts illustrating different preferred embodiments of a printing method according to the present invention.

DETAILED DESCRIPTION OF THE INVENTION

The above mentioned advantage and also other features of this invention will become more apparent, and the invention itself will best be understood, from a study of the following description and appended claims, with reference to the attached drawings showing some preferred embodiments of the invention.

In order to attain a good understanding, first some introductory definitions have to be explained.

As stated before, this invention relates to a method of representing an image of the interior of the human body obtained during medical diagnosis _further called "medical image"_, more particularly to a method for representing an image obtained during a Doppler ultrasound diagnosis, which image was converted to or was available in digital form and electronically stored.

Said medical image is represented by electrical "input image data $I_u$" which are generally provided as binary pixel values in proportion to the densities of the corresponding pixels in the original image.

In accordance with one example of practice, a medical full color image is separated (using known techniques for the purpose) into red (R), green (G) and blue (B) color separations or into yellow (Y), magenta (M) and cyan (C) color separations, each further called "color selections S". These three color selections of a medical image preferably are represented by three color data files $f_i$ of corresponding bitmaps. In case of a color coded image, said color selections do not necessary reflect primary or secondary colors (as RGB or YMC), but may be chosen ad hoc.

Theoretically, a television monitor operates according to an additional color principle and has a three-dimensional color space, known under the name of RGB-space. A thermal printer generally uses a subtractive color principle and has a four-dimensional color-space, called CMYK-space. In the present application, it is supposed that the medical image is supplied in an appropriate color space. Often, an RGB image has to be converted into a CMYK image.

As it has been stated hereabove, a hard-copy of a color-coded image or of a colored image can be printed by a thermal printer. In such a thermal printer a dye donor element and a suitable image receiving material, e.g. a coated paper or coated polyester substrate, are contacted with each other and an image is formed on the image receiving material by heating the back of the dye donor element with a thermal head formed of, for example a plurality of individual heating elements. Said dye donor element is sometimes also indicated as "ribbon" or "web" or "transfer strip"; said receiver element, sometimes also is indicated as "acceptor" or as "recipient sheet".

When a particular heating element is energized, it is heated and causes dye from the dye donor element to transfer to the image receiving material. The density or darkness of the printed image is a function of the energy delivered from the heating element to the dye donor element.

Figure 1:
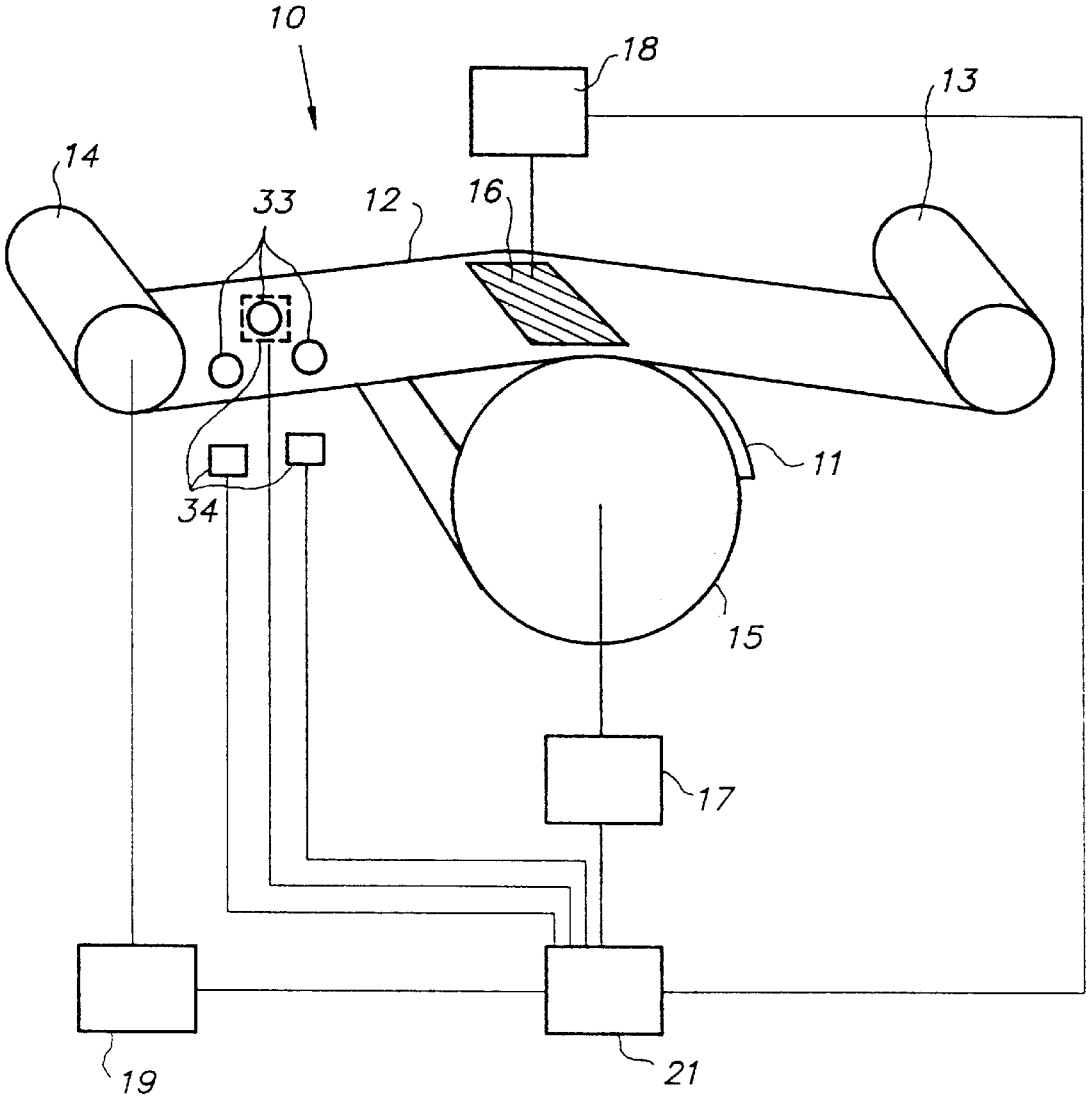
FIGS. 1 and 2 are two schematic layouts of a thermal printing system usable in the present invention.
Figure 2:
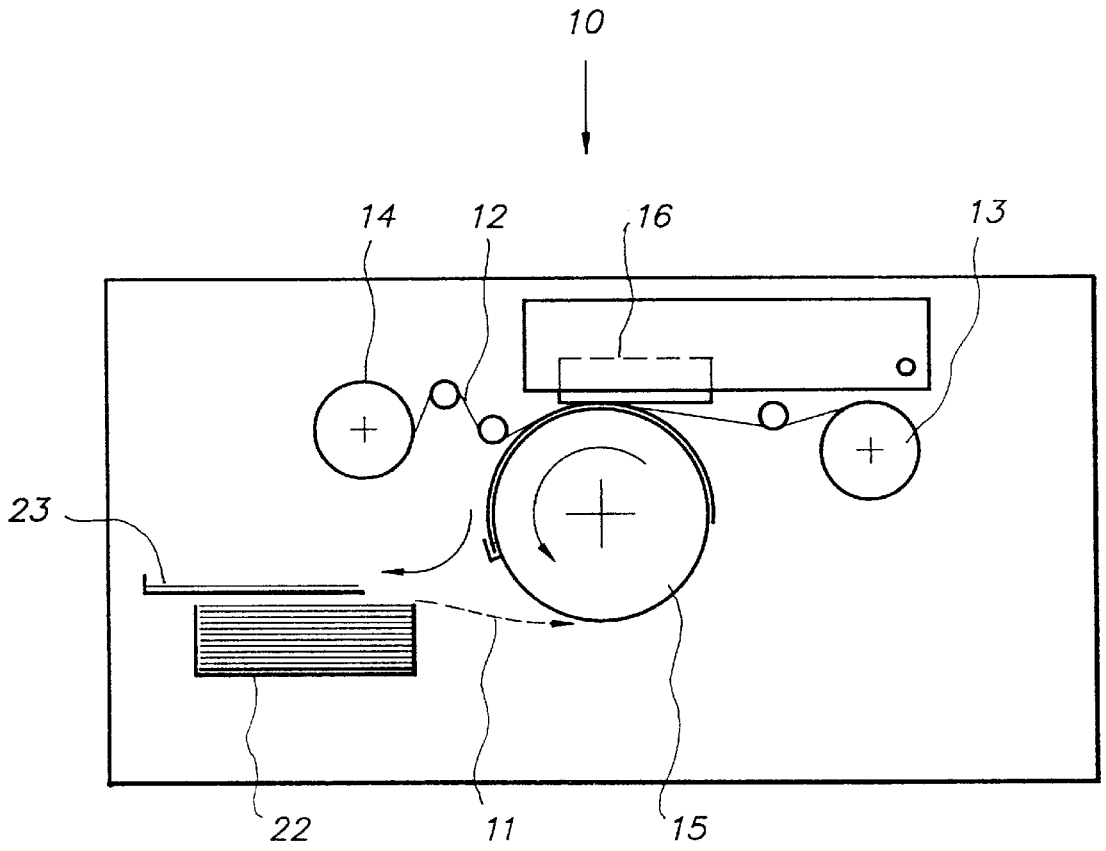

The general working of a thermal printing system in connection with the present invention will first be explained refering to FIGS. 1 and 2. These FIGS. 1 and 2 show two schematic layouts of a thermal printer 10 which uses a receiver element 11 and a dye donor element 12. The receiver element 11 in the form of a sheet is secured to a rotatable printing drum 15 which is mechanically coupled to a drive mechanism 17 that continuously advances the receiver 11 along a path passing a stationary thermal head 16. Thermal head 16 has a plurality of heating elements (not shown) that can be selectively energized by a micro computer 21 providing signals to a thermal head control circuit 18. Dye donor element 12 is supplied from suply roller 13 and can be continuously advanced by drive mechanism 19 mechanically coupled to take-up roller 14. Micro-computer 21 controls drive mechanisms 17 and 19. The printer additionally includes a mechanism (not shown for reason of greater clarity) for pressing the donor element and the receiver element in superposition against the printing drum for thermal transfer, and a pinch roller (not shown) movable toward and away from the drum for pressing the receiver sheet against the drum.

The printing head in connection with the present invention can be any means for causing imagewise heating such as e.g. a laser known in laser induced dye transfer or a printing head having a plurality of selectively energizable heating elements. The latter is preferred in the present invention and is also used to illustrate the invention in the following description.

Figure 3:
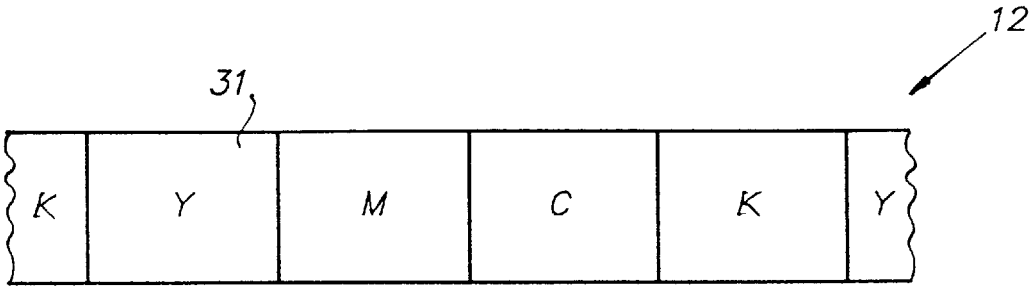
FIGS. 3, 4 and 5 show dye donor elements usable in the present invention.

Basically, in a printer of this type, each receiver element is printed upon while being pressed against a rotatable drum by the thermal printing head via an elongate strip of transfer sheet or donor element. The thermal head has a plurality of electric heating elements which are aligned lengthwise of the printing drum. The electric current fed to the heating elements is controlled for printing dots or "pixels" (picture elements) on the receiver element line by line with the incremental rotation of the printing drum. FIG. 3 shows an exemplary dye donor element 12 containing a sequence of yellow Y, magenta M, cyan C and black K dye frames 31.

In a first embodiment of conventional black-and-white printing, the donor element has black-and-white dye frames, and the just mentioned basic process takes place once for each image. In a second embodiment of black-and-white printing according to the state of the art, even a dye donor element containing dye frames of different color (indicated as YMC) may be used for printing black and white images.

In conventional color printing, the donor element has color dye frames, and the just mentioned basic process takes place once for each color selection. As said donor element bears on its different longitudinal sections the dyes of the three primary colors, yellow, magenta and cyan, a black dye may also be used to add detail and contrast to the printed reproduction (indicated as YMCK). The dye of a first preselected color is first transferred from the color donor element to the receiver element while the latter is traveling forwardly past the drum in superposition with the required dye section of the color donor element. Then the same receiver sheet is recirculated for the transfer of the dye of a second preselected color from the donor element to the receiver sheet. The same procedure is repeated on the same receiver sheet until the three or four monochrome images of the desired color reproduction are all formed in register on one and same receiver sheet.

The present application differs from both just mentioned conventional printings in that it comprises an unconventional "color on monochrome" printing. Although this invention will be explained more in detail in the further description, first a general survey is given hereinafter.

In color on monochrome printing, the donor element has monochrome, preferably black-and-white or achromatic dye frames, and the just mentioned basic process takes place once for each desired color selection. The dye of a first color selection electric is first transferred from a monochrome donor element to a receiver sheet while the latter is traveling forwardly past the drum in superposition with the required dye section. Then a second receiver sheet may or may not be fed forward for the transfer of the dye of optionally a second preselected color from the donor element to the second receiver sheet. The same procedure may be repeated on a third receiver sheet until all, mostly three or four, monochrome images of the desired color reproduction are formed on separate receiver sheets.

Table 1 schematically illustrates the basic difference between a printing method of a medical image according to the state of the art, and a printing method (with some four preferred embodiments) of a medical image according to the present invention, called "color on monochrome printing". Following referrals are indicated: $P_{color}$=a color print, $P_m$=a monochrome print, $S_{\lambda si}$=a color selection i comprising a spectral wavelength λs, $P_{\lambda rj}$=a print j comprising a spectral wavelength λr. Remark that a printing method according to the present invention does not sum all available color selections.

TABLE 1

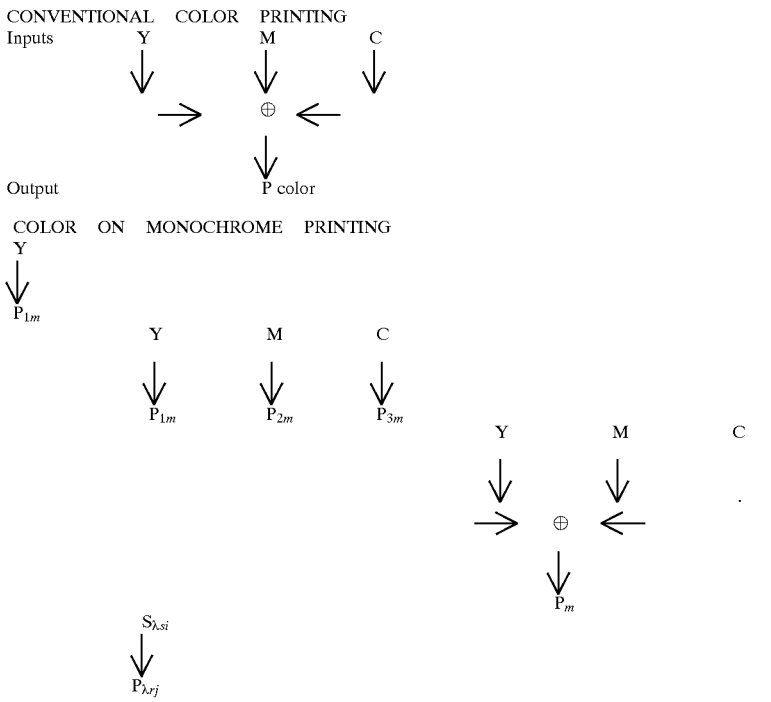

Surprisingly, we have found that in ultrasound radiology, especially in "flow Doppler and in power Doppler" radiology used to discriminate fine details in the images of human soft tissues (as e.g. a liver or a kidney), the attained medical information and even the attained perceptibility can be increased considerably. Indeed, several experiments have confirmed that thermal printing of separate color data files realised on separate monochrome materials, provided diagnostical information which was not optimally perceptable in a color material.

Therefor, the present application provides a method of printing a selected color of an electronically stored medical image, by means of thermal sublimation, using a dye donor element having dye frames, a receiver element receiving dye from said dye frames, and a line type thermal printing head with a plurality of heating elements, characterized in that said medical image is color coded (with a backing-up, highlighting or spot color) in case of flow Doppler diagnosis, or colored (with color selections) in case of power Doppler diagnosis, and that said dye frames are monochrome.

In order to carry out this method of printing, several precautions have to be taken, as will be described immediately in further details.

Figure 4:
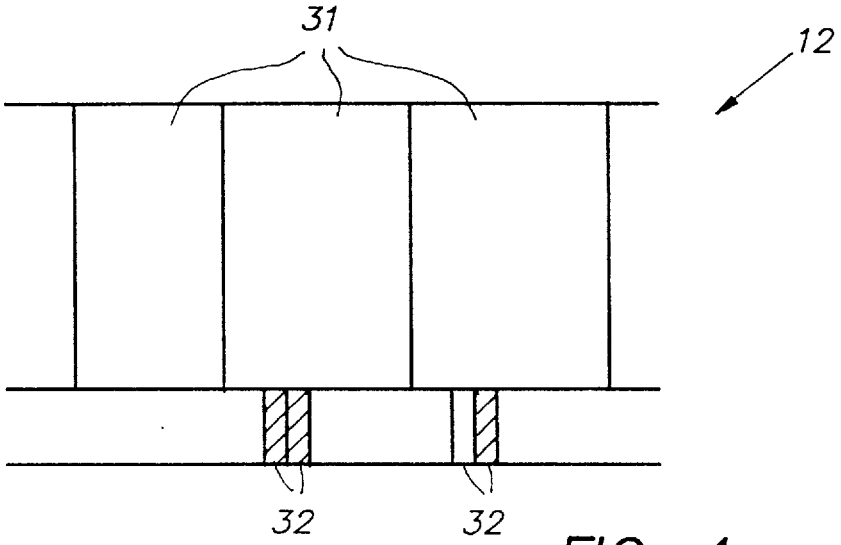
Figure 5:
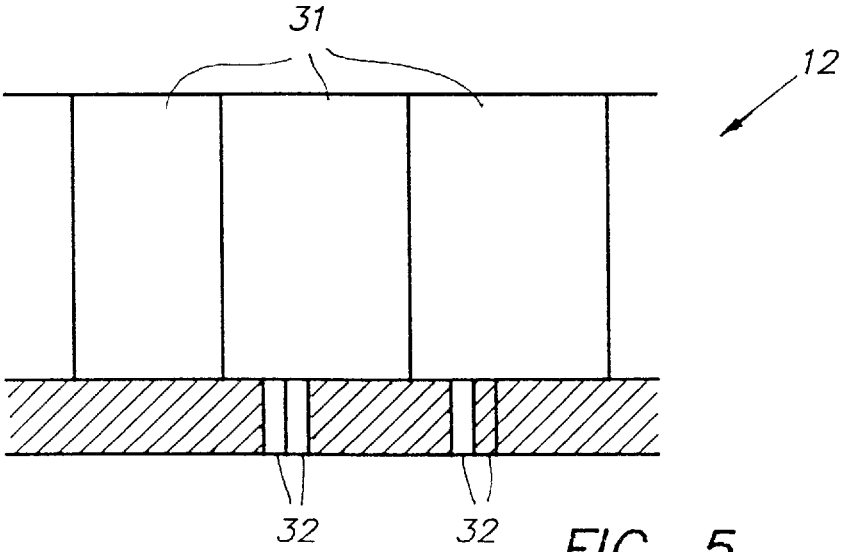

First, when using a conventional color printing machine for an unconventional "color on monochrome" printing according to the present invention, some detection circuits have to be adjusted. Referencing to FIGS. 4 and 5, there is shown a dye donor element containing repeating dye frames 31. In a margin of the dye donor element detection areas 32 occur at a regular distance from each other and may be transparent (cfr. FIG. 4) or may be dyed (cfr. FIG. 5). A dye donor element as shown in FIG. 4 or 5 can be used in combination with LEDs and photodetectors to detect between a dye donor element for black and white printing or for color printing and at the same time identification of a dye frame in color printing is possible. This is explained in detail in our U.S. patent application Ser. No. 08/226,684, so that here only a general survey is given hereinafter (see FIGS. 1, 4 and 5).

Light emitted by LEDs 33 passing through the dye donor element 12 is detected by photodetectors 34. Photodetectors 34 provide a logical signal 0 or 1 to micro computer 21 depending on whether the intensity of the detected light is above or below (or vice versa) a threshold value. The logical signals provided by one or more photodetectors 34 are used for positioning dye donor element 12 in its start positioning for printing an image. Thus until a certain logical pattern from photodetectors 34 matches a predetermined pattern micro-computer 21 will provide signals to drive mechanism 19 to advance dye donor element 12. Micro computer 21 also positions receiver 11 to its home position by controlling drive mechanism 17. Once positioning of dye donor element and receiver has been carried out the printing process can start in accordance with the type of dye donor element detected. Consequently a dye donor element for color printing and one for black and white printing can be distinguished from each other.

In the following part of the description, several preferred embodiments of a printing method according to the present invention will be disclosed. For sake of clarity, every embodiment will be illustrated by a separate flow-chart (cfr. FIGS. 6 to 9), whereafter a general survey flow-chart will be given (in FIGS. 10.1 and 10.2), as well as a general survey table (cfr. Table 2). In these drawings, following referrals are indicated: $I_u$=input data, $f_i$=data file, K=black, Y=yellow, M=magenta, C=cyan, d=donor element, r=receiver element, $d_i$=a specific dye frame of a donor element, $r_i$=a specific sheet of a receiver element.

Figure 6:
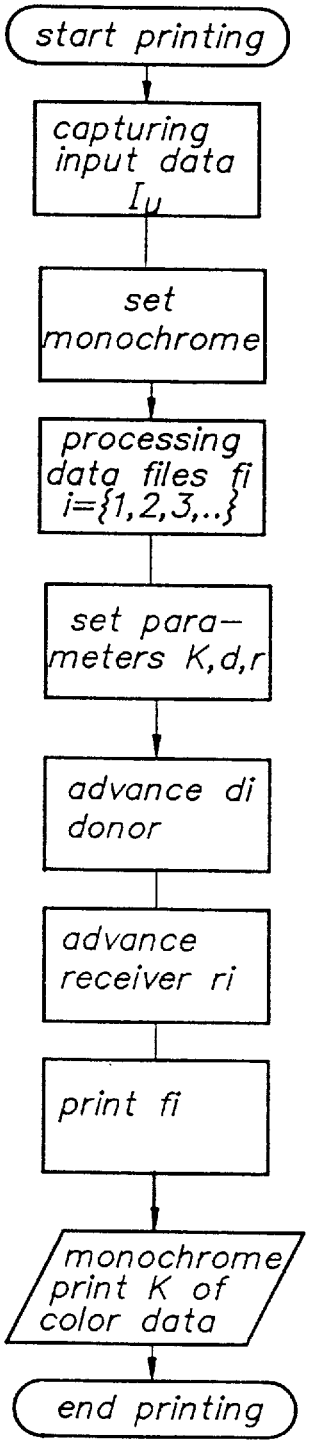

Referencing to FIG. 6, in a further embodiment of the present invention, a method of printing a monochrome print or reproduction P of a color selection S of an electronically stored medical image is provided, by means of thermal sublimation, using a dye donor element having a monochrome dye frame, a receiver element receiving dye from said dye frame, and a line type thermal printing head with a plurality of heating elements, comprising the steps of:

positioning said thermal printing head, said donor element and said receiver element in a position at which an image is to be printed;

supplying input image data $I_u$ (of said color selection), representing the dye density of each pixel, to a processing unit of a thermal printer;

converting said input image data into processed image data $I_c$ that represent a number of activating pulses in accordance to the dye density of each pixel;

activating each heating element with said processed image data Ic;

moving said dye donor element and said receiver element along respective paths so that dye from a dye frame is transferred to the receiver to form an image thereon.

Furthermore, it will generally be necessary to apply corrections to the image data before these data are used to obtain an image of high quality. Type and extent of corrections will also depend on the particular dye donor element being used. For example a different type of correction will generally be necessary when printing a black and white image using a black dye donor element than when a color image is being printed with a dye donor element having a series of differently colored dye frames. Other corrections may include differences in electrical characteristics of the heating elements and/or in physical characteristics of the contact between thermal head, donor element, receiver element and printing drum. An appropriate model is described in our U.S. patent application Ser. No. 08/387,030, and appropriate corrections are described in our U.S. patent applications Ser. No. 08/163,283 and Ser. No. 08/248,336.

Figure 11:
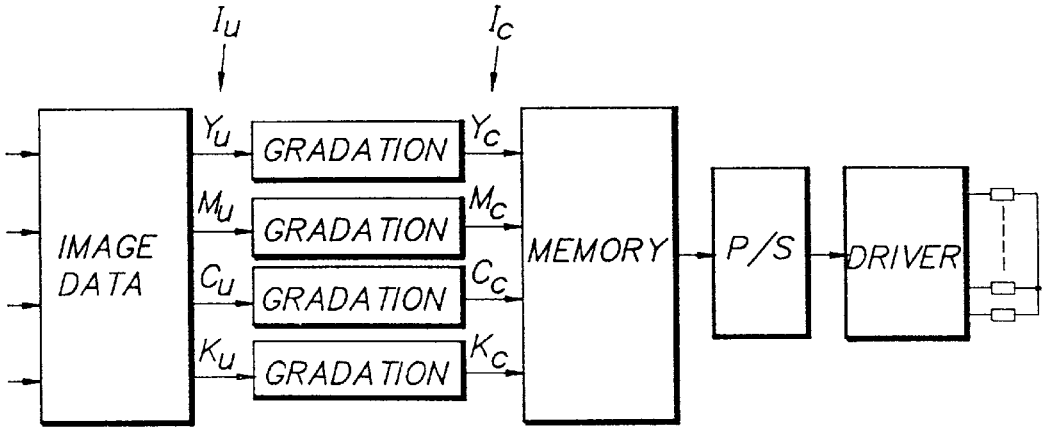
FIG. 11 is a partial block-diagram of the processing of the image data.

Referencing to the partial block-diagram of FIG. 11, in the case of color images, a set of color selection image input data $I_u$ representing yellow, magenta, cyan and black color components of the original color image, respectively are captured. Then, the electrical signals corresponding to the different color selections are processed. The color component signals $Y_u$, $M_u$, $C_u$ and $K_u$ are supplied to respective gradation correction circuits, in which gradation curves suitable for correcting the respective gradations for the yellow, magenta, cyan and black components are stored; preferably said signals are subjected to typical corresponding transformation lookup tables (LUT's). Further, a parallel-to-serial conversion of the processed image data $I_c$. is also indicated in FIG. 11, of which a preferred embodiment is described in our U.S. Pat. No. 5,440,984.

In a still further embodiment of the present invention, said monochrome reproduction P comprises at least two monochrome reproductions $P_1$ and $P_2$, said dye donor element comprises at least two monochrome dye frames each with a common spectral wavelength $\lambda_r$, and all steps are repeating until each color selection has been printed on a separate receiver element. For a clear understanding, it has to be noticed that in the context of the present application, several wordings as "spectral wavelength $\lambda_r$, spectrum, wavelength and bandwidth" reflect nearly the same content; even when it concerns artificial colors or color codes or the electrical representation thereof.

Figure 7:
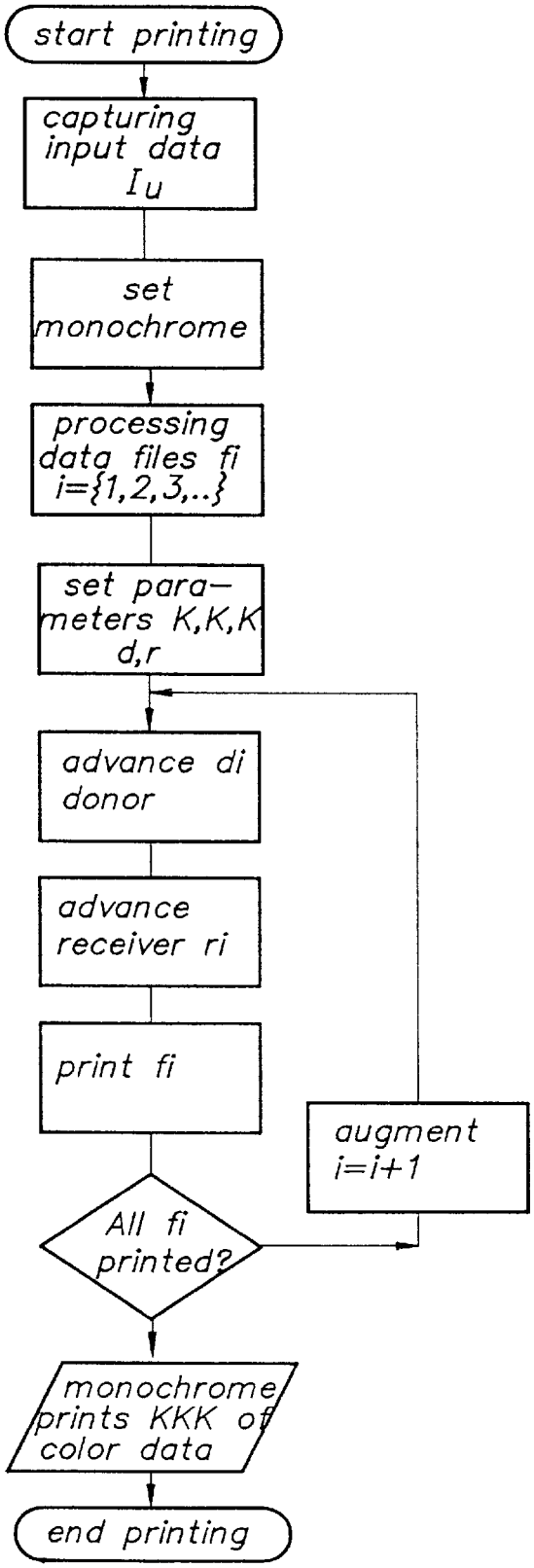
Figure 8:
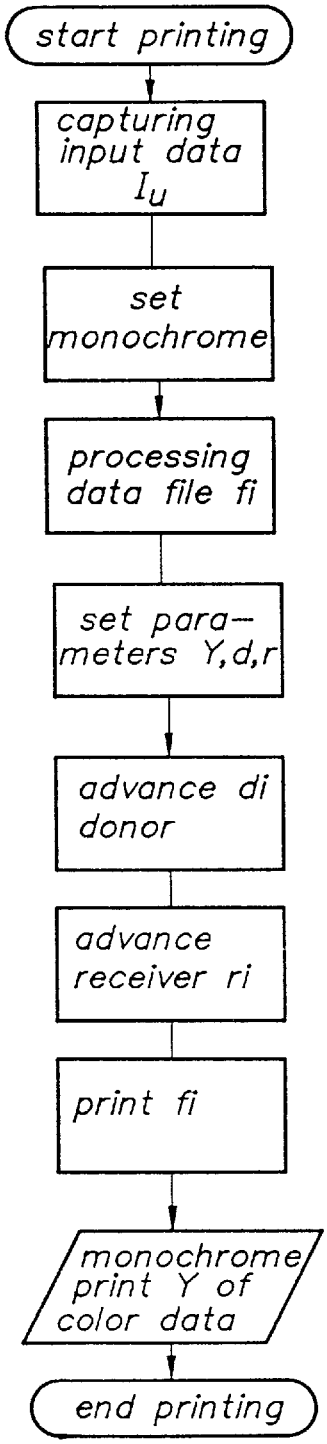
Figure 9:
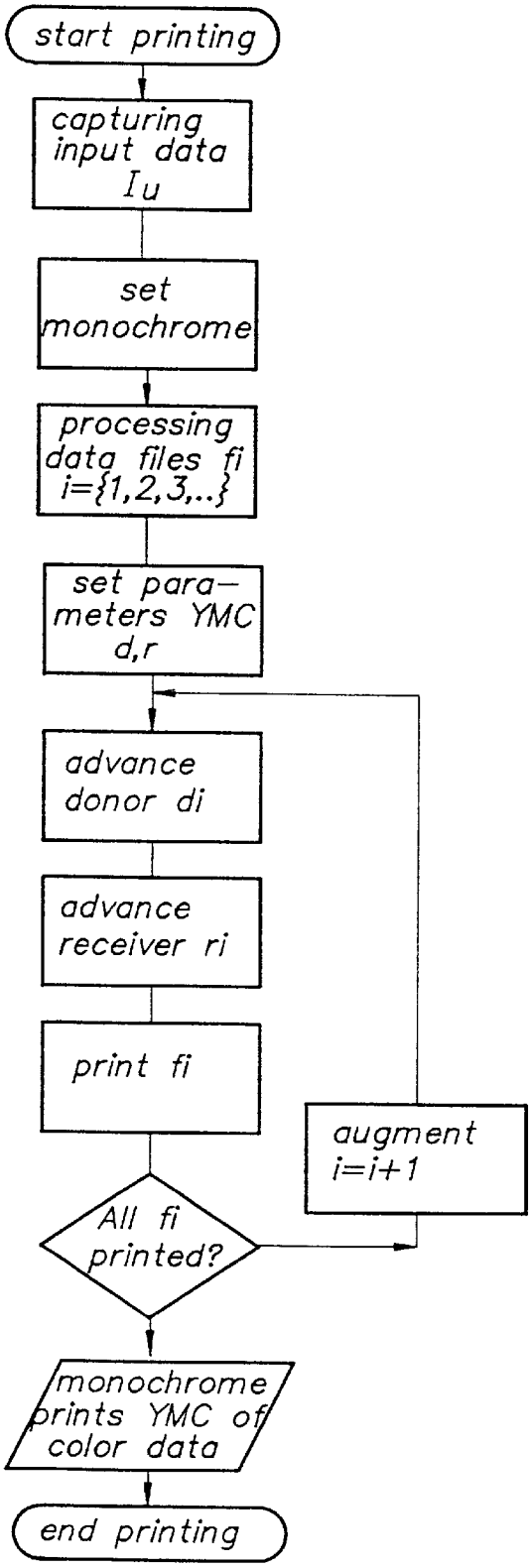

Describing the result hereof in full wording and referencing to FIG. 7, provided is a method of printing at least two monochrome reproductions (with a spectral wavelength $\lambda_r$) of at least two color selections each with a mutual different spectral wavelength $\lambda_{s1}$ and $\lambda_{2s}$ of a color image, by means of thermal sublimation, using a dye donor element having monochrome dye frames each with a common spectral wavelength $\lambda_r$, a receiver element receiving dye from said dye frames, and a line type printing head with a plurality of heating elements, comprising the steps of:

positioning said thermal printing head, said donor element and said receiver element in a position at which an image is to be printed;

supplying input image data $I_{u\lambda}$, representing the dye density of each pixel in accordance to a color selection, to a processing unit of a thermal printer;

converting said input image data $I_{u\lambda}$into processed image data $I_{c\lambda}$that represent a number of activating pulses in accordance to the dye density of each pixel;

activating each heating element with said processed image data $I_{c\lambda}$;

moving said dye donor element and said receiver element along respective paths so that dye from a dye frame is transferred to the receiver to form an image thereon;

repeating all foregoing steps until each color selection has been printed on a separate receiver element/reproduction.

It may be clear for the people skilled in the art that in every embodiment of the present invention, said monochrome reproduction(s) also may be achromatic. Indeed, medical diagnosis executed by a radiologist is generally based upon the visual inspection of a radiographic image recorded on a clear or blue based transparant film.

In a still further embodiment (illustrated in FIG. 8) of the present invention, a method of printing a monochrome reproduction of a color selection of a medical image is provided, by means of thermal sublimation, using a dye donor element having color dye frames, a receiver element receiving dye from said dye frames, and a line type thermal printing head with a plurality of heating elements, comprising the steps of:

positioning said thermal printing head, said donor element and said receiver element in a position at which an image is to be printed;

supplying input image data $I_u$, representing the dye density of each pixel, to a processing unit of a thermal printer;

converting said input image data into processed image data $I_c$ that represent a number of activating pulses in accordance to the dye density of each pixel;

activating each heating element with said processed image data Ic;

moving said dye donor element and said receiver element along respective paths so that dye from a dye frame is transferred to the receiver to form an image thereon.

In a still further embodiment (illustrated in FIG. 9) of the present invention, a method of printing at least two monochrome reproductions each with a same spectral wavelength $\lambda_r$ of at least two color selections each with a mutual different spectral wavelength $\lambda$ of a color image is provided, by means of thermal sublimation, using a dye donor element having monochrome dye frames, a receiver element receiving dye from said dye frames, and a line type thermal printing head with a plurality of heating elements, comprising the steps of:

positioning said thermal printing head, said donor element and said receiver element in a position at which an image is to be printed;

supplying input image data $I_{u\lambda}$. representing the dye density of each pixel in accordance to a color selection, to a processing unit of a thermal printer;

converting said input image data $I_{u\lambda}$ into processed image data $I_{c\lambda}$ that represent a number of activating pulses in accordance to the dye density of each pixel;

activating each heating element with said processed image data $I_{c\lambda}$;

moving said dye donor element and said receiver element along respective paths so that dye from a dye frame is transferred to the receiver to form an image thereon;

repeating all foregoing steps until each color selection has been printed.

FIG. 10 gives a survey flow-chart of several printing methods described hereabove and illustrating as well single reproductions as plural reproductions, in black-and-white as well as in monochrome.

Table 2 gives a survey table of several printing methods described hereabove and illustrates in the consecutive parts of the table some exemplary printing schemes (first example: for a medical image are three YMC color selections S available in corresponding input image data, but only one reproduction P is made in black K on an achromatic receiver sheet), some standard printing schemes (second example: for a medical image are three YMC color selections S available in corresponding input image data, but only one reproduction P is made in magenta M on a color receiver sheet), some extra printing schemes (third example: for a medical image is one Yellow color selection S available in corresponding input image data, and two reproductions P are made on two consecutive Yellow frames of a color receiver sheet), and also some general printing schemes (fourth example: for a medical image are i arbitrary color selections S characterised by their spectral wavelength $\Sigma\lambda_{si}$ available in corresponding summed input image data, and at least one reproduction P characterised by its spectral wavelength $\lambda_{rj}$ is made on a color receiver sheet).

TABLE 2

| Electrical selections S | | Donor dye frames P | |
|---|---|---|---|
| Available | Used | Available | Used |
| Exemplary printing schemes: | | | |
| Y, M, C | Y | K, K, K | K |
| Y, M, C | Y, M | K, K, K | K, K |
| Y, M, C | Y | Y, M, C | Y |
| Y, M, C | Y, M | Y, M, C | Y, M |
| Standard printing schemes: | | | |
| Y, M, C | Y, M, C, K | Y, M, C, Y, M, C | Y |
| Y, M, C | Y, M, C, K | Y, M, C, Y, M, C | M |
| Y, M, C | Y, M, C, K | Y, M, C, Y, M, C | C |
| Y, M, C | Y + M | Y, M, C, Y, M, C | C |
| Extra printing schemes: | | | |
| Y or Y, M, C | Y | Y or Y, M, C | Y |
| Y or Y, M, C | Y | Y or Y, M, C | M |
| Y or Y, M, C | Y | Y, M, C, Y, M, C | Y_Y_ |
| General printing schemes: | | | |
| $\lambda_{si}$ | $\lambda_{si}$ | $\lambda_{rj}$ | $\lambda_{rj}$ |
| $\lambda_{si}$ | $\lambda_{si}$ | $\lambda_{ri}$ | $\lambda_{ri}$ |
| $\forall\lambda_{si}$ | $\forall\lambda_{si}$ | $\lambda_{rj}$ | $\lambda_{rj}$ |
| $\Sigma\lambda_{si}$ | $\forall\lambda_{si}$ | $\forall\lambda_{rj}$ | $\lambda_{rj}$ |

Within the scope of the present invention, it is not strictly necessary that each color selection S exactly corresponds with classical YMC spectral wavelengths or bandwidths, but appropriate spectral wavelengths or bandwidths may be chosen. Therefor, FIG. 3 has to be interpreted more generally as illustrating a dye donor element having color dye frames comprising a sequence of monochrome dye frames with different spectral wavelengths $\lambda_{jr}$.

As it was already indicated in Table 1, optionally also a combination of two color selections (e.g. Y and M, or two other wavelenghts $\lambda_{si}$) may be defined (electronically) and printed on a monochrome material. According to such an embodiment, a method of printing a monochrome reproduction P of two different color selections $S_1$ and $S_2$ with different spectral wavelengths $\lambda_{s1}$ and $\lambda_{s2}$ of an electronically stored multicolor medical image is provided by means of thermal sublimation, using a dye donor element having monochrome dye frames, receiver elements receiving dye from said dye frames, and a line type thermal printing head with a plurality of heating elements, comprising the steps of:

positioning said thermal printing head, said donor element and a receiver element in a position at which an image is to be printed;

supplying input image data $I_{u\lambda}$,representing the dye density of each pixel in accordance to each color selection, to a processing unit of a thermal printer;

summing vectorially the input image data $I_{u\lambda}$) corresponding to each color selection to resulting data, called "summing data" $I_s$;

converting said summing data $I_s$ into processed image data $I_c$ that represent a number of activating pulses;

activating each heating element with said summing data $I_s$;

moving said dye donor element and said receiver element along respective paths so that dye from a dye frame is transferred to the receiver element to form an image thereon.

In a further preferred embodiment of the present invention, a method is implemented wherein the step of activating the heating elements is executed "duty cycled pulsewise". Such activating is described in our U.S. patent application Ser. No. 08/163,283.

In a still further preferred embodiment of the present invention, a method is implemented wherein the step of converting the input data into processed image data also comprises corrections as described in our patent applications EP-A-92.203.816.1 and EP-A-93.201.534.0.

In still further preferred embodiments of the present invention, additional steps may also be included, as e.g.:

discriminating whether the receiver element is of a neutral-transparant, a colored-transparant or a non-transparant sheet;

printing an image taking into account the detected type of dye donor element;

alerting an operator when the type of donor element is incompatible with the type of receiver element; etc.

As it may be clear from the description given hereabove, one advantage of the present invention relates to the increased quantity and the increased quality (cfr. perceptibility) of the printed medical image. Another great advantage of the present invention relates to economical profits, resulting from a technique which is highly reliable but not complicated, and from donor materials which are less expensive.

The present invention may be used in a color printer wherein a set of monochrome images of a desired color reproduction are thermally transferred from a color donor element to a receiver sheet, preferably as the latter is fed by and past a drum disposed intermediate a sheet loading station and a sheet unloading station.

Thermal imaging can be used for both the production of transparencies and reflection type prints. In the hard copy field recording materials on white opaque base are used, whereas in the medical diagnostic field black imaged transparencies find wide application in inspection techniques operating with a light box.

It is included in the scope of the present invention to represent a medical image in an analog form by means of one or more video signals, one for each color selection, or it may be represented by a set of digital bitmap forms.

The thermal head in connection with the present invention can be any means for causing image-wise heating such as e.g. a printing head having a plurality of selectively energizable heating elements or an addressable laser. A heating method wherein heating of the dye donor element is carried out with a laser is known as laser induced dye transfer (cfr. patent EP 0 343 443).

Also included in the present invention, is a method of printing a selected color of an electronically stored medical image, which image was converted to or was available in digital form and thus represented by electrical input image data, available in a laser recording system, using an electronically adressed laser for recording by means of at least tree video input signals on a laser-sensitive medium (e.g. film), characterized in that said video input signals are colored or color coded and that said laser-sensitive medium is monochrome.

It is, of course, understood that variations may be made in the form, details and arrangements of the various embodiments of the present description, in order to conform to design preferences or to the requirements of each specific application of this invention. The following claims are intended to cover all such variations or modifications of the illustrated embodiments as will readily occur to one skilled in the art.

We claim:

1. A method of printing a monochrome reproduction P of two different color selections $S_1$ and $S_2$ with different spectral wavelengths $\lambda_{s1}$ and $\lambda_{s2}$ of an electronically stored multicolor medical image, by means of thermal sublimation, using a dye donor element having monochrome dye frames, receiver elements receiving dye from said dye frames, and a line type thermal printing head with a plurality of heating elements, comprising the steps of:

a) positioning said thermal printing head, said donor element and a receiver element in a position at which an image is to be printed;

b) supplying input image data $I_{u\lambda}$, representing the dye density of each pixel in accordance to each color selection, to a processing unit of a thermal printer;

c) summing the input image data $I_{u\lambda}$corresponding to each color selection to resulting data, called "summing data" $I_s$;

d) converting said summing data $I_s$ into processed image data $I_c$ that represent a number of activating pulses;

e) activating each heating element with a number of activating pulses corresponding with said summing data $I_s$;

f) moving said dye donor element and said receiver element along respective paths so that dye from a dye frame is transferred to the receiver element to form an image thereon;

wherein both said color selections $S_1$ and $S_2$ together have been printed by transfer of a monochrome dye on one single receiver element.

2. A method according to claim 1, wherein the step of activating each heating element is executed duty cycled pulsewise.

3. A method according to claim 1, wherein the step of converting the summing data ($I_s$) into processed image data ($I_c$) also comprises corrections.

4. A method of printing at least two monochrome reproductions with a common spectral wavelength $\lambda_r$ of at least two different color selections $S_1$ and $S_2$ with different spectral wavelengths $\lambda_{s1}$ and $\lambda_{s2}$ of an electronically stored multicolor medical image by means of thermal sublimation using a dye donor element having dye frames, receiver elements receiving dye from the dye frames, and a thermal printer having a processing unit and a line-type thermal printing head, the thermal printing head having a plurality of heating elements, the method of printing comprising the steps of:

(a) positioning the thermal printing head, the dye donor element, and one of the receiver elements in a position at which an image is to be printed;

(b) supplying input image data ($I_{u\lambda}$), representing the dye density of each pixel of the monochrome reproduction to be printed in accordance with a color selection, to the processing unit of the thermal printer;

(c) converting the input image data ($I_{u\lambda}$) into processed image data ($I_{c\lambda}$), the processed image data ($I_{c\lambda}$) representing a number of activating pulses in accordance with the dye density of each pixel;

(d) activating each heating element of the thermal printing head with the processed image data ($I_{c\lambda}$);

(e) moving the dye donor element and the receiver element along respective paths so that dye from the dye donor element is transferred to the receiver element to form an image thereon, wherein the dye donor element has color dye frames comprising a sequence of monochrome dye frames with different spectral wavelengths $\lambda_{jr}$ of which one dye is transferred;

(f) before step (e), discriminating whether the receiving element is a neutral-transparent, a colored-transparent, or a non-transparent sheet; and (g) repeating the foregoing steps until each color selection has been printed on a separate receiver element.

5. A method of printing at least two monochrome reproductions with a common spectral wavelength $\lambda_r$ of at least two different color selections $S_1$ and $S_2$ with different spectral wavelengths $\lambda_{s1}$ and $\lambda_{s2}$ of an electronically stored multicolor medical image by means of thermal sublimation using a dye donor element having dye frames, receiver elements receiving dye from the dye frames, and a thermal printer having a processing unit and a line-type thermal printing head, the thermal printing head having a plurality of heating elements, the method of printing comprising the steps of:

(a) positioning the thermal printing head, the dye donor element, and one of the receiver elements in a position at which an image is to be printed;

(b) supplying input image data ($I_{u\lambda}$), representing the dye density of each pixel of the monochrome reproduction to be printed in accordance with a color selection, to the processing unit of the thermal printer;

(c) converting the input image data ($I_{u\lambda}$) into processed image data ($I_{c\lambda}$), the processed image data ($I_{c\lambda}$) representing a number of activating pulses in accordance with the dye density of each pixel;

(d) activating each heating element of the thermal printing head with the processed image data ($I_{c\lambda}$);

(e) moving the dye donor element and the receiver element along respective paths so that dye from the dye donor element is transferred to the receiver element to form an image thereon, wherein the dye donor element has color dye frames comprising a sequence of monochrome dye frames with different spectral wavelengths $\lambda_{jr}$ of which one dye is transferred;

(f) before step (e), detecting the type of dye donor element; and (g) repeating the foregoing steps until each color selection has been printed on a separate receiver element.

6. The method according to claim 5, wherein each of steps (a) through (e) comprises taking into account the detected type of dye donor element.

7. The method according to claim 5, further comprising the steps of:

detecting the type of the receiver element on which the monochrome reproduction is to be printed; and alerting an operator when the detected type of the dye donor element is incompatible with the the detected type of the receiver element.

8. A method of printing at least two monochrome reproductions of an electronically stored multicolor medical image by means of thermal sublimation using a thermal printer having a processing unit and a line-type thermal printing head, the thermal printing head having a plurality of heating elements, each monochrome reproduction comprising of a separate color selection, the method of printing comprising the steps of:

(a) providing a dye donor element having a plurality of monochrome dye frames, each dye frame corresponding to one of the monochrome reproductions to be printed, the dye frames having a common spectral wavelength ($\lambda_r$);

(b) providing a plurality of receiver elements for receiving dye from the dye donor element, each receiver element corresponding to one of the monochrome reproductions to be printed;

(c) positioning the thermal printing head, the dye donor element, and one of the receiver elements in a position at which one of the monochrome reproductions is to be printed;

(d) supplying input image data ($I_u$) according to the color selection of the monochrome reproduction to be printed, the input image data ($I_u$) representing the dye density of each pixel of the monochrome reproduction to be printed to the processing unit of the thermal printer;

(e) converting the input image data ($I_u$) into processed image data ($I_c$), the processed image data ($I_c$) representing a number of activating pulses in accordance with the dye density of each pixel;

(f) activating each heating element of the thermal printing head with the processed image data ($I_c$);

(g) moving the dye donor element and the receiver element corresponding to the monochrome reproduction to be printed along respective paths so that dye from the dye donor element is transferred to the receiver element to form an image thereon;

(h) before step (g), discriminating whether the receiving element corresponding to the monochrome reproduction to be printed is a neutral-transparent, a colored-transparent, or a non-transparent sheet; and (i) repeating steps (c) through (h) until each monochrome reproduction has been printed on a separate receiver element.

9. A method of printing at least two monochrome reproductions of an electronically stored multicolor medical image by means of thermal sublimation using a thermal printer having a processing unit and a line-type thermal printing head, the thermal printing head having a plurality of heating elements, each monochrome reproduction comprising of a separate color selection, the method of printing comprising the steps of:

(a) providing a dye donor element having a plurality of monochrome dye frames, each dye frame corresponding to one of the monochrome reproductions to be printed, the dye frames having a common spectral wavelength ($\lambda_r$);

(b) providing a plurality of receiver elements for receiving dye from the dye donor element, each receiver element corresponding to one of the monochrome reproductions to be printed;

(c) positioning the thermal printing head, the dye donor element, and one of the receiver elements in a position at which one of the monochrome reproductions is to be printed;

(d) supplying input image data ($I_u$) according to the color selection of the monochrome reproduction to be printed, the input image data ($I_u$) representing the dye density of each pixel of the monochrome reproduction to be printed to the processing unit of the thermal printer;

(e) converting the input image data ($I_u$) into processed image data ($I_c$), the processed image data ($I_c$) representing a number of activating pulses in accordance with the dye density of each pixel;

(f) activating each heating element of the thermal printing head with the processed image data ($I_c$);

(g) moving the dye donor element and the receiver element corresponding to the monochrome reproduction to be printed along respective paths so that dye from the dye donor element is transferred to the receiver element to form an image thereon;

(h) before step (g), detecting the type of dye donor element; and (i) repeating steps (c) through (h) until each monochrome reproduction has been printed on a separate receiver element.

10. The method according to claim 9, wherein each of steps (c) through (g) comprises taking into account the detected type of dye donor element.

11. The method according to claim 9, further comprising the steps of:

detecting the type of the receiver element on which the monochrome reproduction is to be printed; and alerting an operator when the detected type of the dye donor element is incompatible with the detected type of the receiver element.

* * * * *